US008708517B2

(12) United States Patent
Lou et al.

(10) Patent No.: US 8,708,517 B2
(45) Date of Patent: Apr. 29, 2014

(54) LED ROADWAY LUMINAIRE

(71) Applicants: Xiaomei Lou, Solon, OH (US); Matthew Steven Mrakovich, Streetsboro, OH (US); Mark J. Mayer, Sagamore Hills, OH (US); David J. Page, Painesville, OH (US); Babi Koushik Saha, Brunswick, OH (US)

(72) Inventors: Xiaomei Lou, Solon, OH (US); Matthew Steven Mrakovich, Streetsboro, OH (US); Mark J. Mayer, Sagamore Hills, OH (US); David J. Page, Painesville, OH (US); Babi Koushik Saha, Brunswick, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 0 days.

(21) Appl. No.: 13/939,537

(22) Filed: Jul. 11, 2013

(65) Prior Publication Data

US 2013/0294058 A1 Nov. 7, 2013

Related U.S. Application Data

(63) Continuation of application No. 13/107,382, filed on May 13, 2011, now Pat. No. 8,485,684.

(51) Int. Cl.
*F21V 1/00* (2006.01)

(52) U.S. Cl.
USPC .. 362/217.05; 362/224; 362/225; 362/217.07

(58) Field of Classification Search
USPC ..... 362/217.05, 224, 225, 217.07, 236
See application file for complete search history.

(56) References Cited

U.S. PATENT DOCUMENTS 4,225,906 A * 9/1980 Gulliksen et al. ..... 362/254
2011/0235335 A1* 9/2011 Ishida et al. ..... 362/296.01

* cited by examiner

*Primary Examiner* — Evan Dzierzynski
(74) *Attorney, Agent, or Firm* — Fay Sharpe LLP

(57) ABSTRACT

The luminaire comprises a housing including at least one optical module. The optical module has a plurality of light emitting diodes disposed within a reflector. The reflector includes opposed curved longitudinal walls and opposed curved end walls.

20 Claims, 7 Drawing Sheets

LED ROADWAY LUMINAIRE

This application claims priority from U.S. patent application Ser. No. 13/107,382, filed on May 13, 2011, hereby incorporated by reference in its entirety.

BACKGROUND

The present disclosure relates to lighting fixtures, and more particularly to outdoor lighting fixtures for distributing patterns of light on the ground. These lighting fixtures can be used for area lighting, including roadway, parking lot, walkway, bicycle path, or other similar applications.

In general, roadway lighting fixtures consist of a lamp or other light source, a lens, and a reflector for refracting and/or reflecting light from the light source. The reflector, lens and any shielding typically define the light distribution pattern.

Highway and roadway lighting have historically used incandescent and more recently high intensity discharge (HID) lamps that can provide adequate amounts of light, but which have several drawbacks, including frequent lamp failures and poorly distributed lighting of the roadway surface. Incandescent and HID lamps are omni-directional sources and have relatively poor control of the light which results in lower utilization. Uncontrolled light can be wasted in lighting areas around the roadway (and potentially, sidewalk) that do not require light, and contributes to trespass light and light pollution which can interfere with the preservation of the nighttime environment.

As advances in the quality and energy efficiency of lighting sources such as light emitting diodes (LEDs) have improved, their production costs have gone down. As a result, LEDs, are being more commonly used in outdoor lighting applications. Initial efforts to incorporate LEDs into lighting fixtures have involved retrofitting LEDs into conventional luminaries or onto or into the shape of conventional lighting luminaires.

LEDs provide an effective means to achieve targeted illumination. However, careful design of the luminaire package is required. Light energy spreads over an area as a function of distance. The illumination of a remote area therefore varies inversely as the square of the distance from the light source. Additionally, since light fixtures direct light to a relatively large target area, the light source is many times smaller than the area to be lighted. Accordingly, the luminaire produced by each fixture must be relatively intense to cover a substantial area.

FIGS. 1A to 1G show types of roadway illumination patterns. These are designed to provide effective illumination of various conditions. Moreover, a roadway luminaire should be capable of illuminating one or several lane roadways, should accommodate a variety of pole spacing's, and may be required to provide backwards illumination of a sidewalk, to name just a few exemplary requirements. The Illuminating Engineering Society of North America (IESNA) is an accepted technical authority on illumination and puts out specifications for five primary types of roadway illumination.

The classification type is defined by the half maximum iso-candella line in relation to street side transverse (across the road) mounting heights. This is independent of the longitudinal (along the road) capability which is defined by the relationship of the projected maximum candela to longitudinal mounting heights. The type classification represents the amount of forward throw of the distribution and can be generally equated to the number of lanes or distance of coverage.

Type I illumination, FIG. 1A, is a direct illumination in two directions along the direction of the roadway wherein the lamp post can be median mounted between opposite flows of traffic and/or in a straight directional pattern at a cross section as shown in FIG. 1B. FIG. 1C shows an omni-directional lighting pattern across the entire intersection. FIG. 1D shows a lighting fixture which directs light at an angle (asymmetrically) to normal in either two directions, or in four directions as shown in FIG. 1E, Type II illumination. Type III illumination in FIG. 1F shows a greater angle, or illumination from normal as compared to Type II (FIG. 1D). Type IV illumination (FIG. 1G) has an even wider angle of illumination from normal. As described above, these illumination patterns are desired to effect lighting of various application conditions.

There are additional problems presented to the lighting designer. First of all, to maintain a given light level at a distant target area, the light source must produce a high level of light intensity. This can contribute to glare problems for those viewing the fixtures. Spill and glare are inefficient use of the light and are frequently objectionable. Spill light primarily wastes energy and should be minimized although some controlled spill light is necessary to provide a gradient and light the roadway peripherals. Spill results in wide-scale lighting of areas, which makes the actual roadway less distinct from surrounding areas. Additionally, lack of control also translates, in many applications, into the utilization of more light poles and lighting fixtures, which is expensive and consumes substantial resources.

Having a light engine which is adaptable to provide a wide array of light distribution patterns allows precise control of light. One advantage of the present disclosure is that by providing an adaptable modular lighting fixture, it is feasible to readily select fixture modules having suitable light distribution and orientation to properly light almost any area.

BRIEF DESCRIPTION

According to a first embodiment, a roadway luminaire is provided. The luminaire comprises a housing including an electronics module and at least one optical module. The optical module includes at least one light source disposed within a reflector. The reflector includes opposed curved longitudinal walls and opposed curved end walls.

According to a further embodiment, a roadway luminaire is provided. The luminaire includes a housing containing at least one optical module. The optical module is comprised of a printed circuit board (PCB) including a plurality of light emitting diodes and a reflector encompassing the printed circuit board. The light emitting diodes are arranged into at least three arrays, a first array disposed adjacent a first end of the PCB, a second array disposed adjacent a second end of the PCB, and a third array disposed between the first and second.

According to a third embodiment, a luminaire is provided. The luminaire is comprised of a housing including at least two optical modules. The optical modules have a plurality of light emitting diodes disposed within a reflector. The reflector has opposed curved sidewalls and opposed curved end walls.

DETAILED DESCRIPTION

LED roadway luminaires can be evaluated by their coefficient of utilization (CU). It is desirable, for a given amount of lumens, that the LED fixture direct the light precisely where it is needed and waste very little light upwardly or in surrounding areas. The presently disclosed luminaire has a particularly well controlled light distribution and a superior CU.

It is also desirable to have a highly adaptable luminaire which can accommodate a variety of lighting requirements with a limited number of required components. The present roadway luminaire is a modular system that provides maximum design flexibility through a minimum number of interchangeable components. The low number of necessary components allows easy maintenance of the supply chain and provides short lead times to the customer.

In this regard, the luminaire of the present disclosure is designed to include one or more optical modules. It is envisioned that between one and four modules would be sufficient for most applications. Each optical module can be comprised of a reflector surrounding a plurality of LED's disposed on a printed circuit board.

While LED's are the primary focus of this disclosure, it is contemplated that a fluorescent lamp or fluorescent strip element could provide similar functionality. Moreover, most embodiments will employ an elongated light source which could be comprised of two LEDs. The system can have a plurality of LED loadings on the printed circuit boards to provide a variety of illumination levels. Moreover, it is envisioned that multiple levels of LED loaded printed circuit boards could be available; however, the printed circuit boards are preferably commonly sized and shaped to allow interchangeability with the various reflector options available. In that regard, the system can contain multiple reflector components designed to provide various light distribution patterns. For example the reflectors can be designed to provide alternative amount of forward directed light and alternative amount of sideways directed light. In this regard, a suitable reflector can be selected depending upon how many lanes of a roadway are being illuminated and how far apart poles are spaced. An exemplary modular system may provide up to six different reflector designs.

Figure 1A:
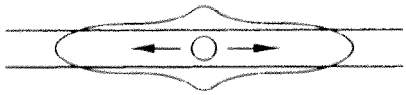
FIGS. 1A-1G illustrate types of roadway illumination patterns.
Figure 1B:
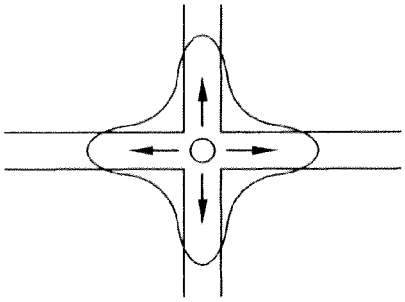
Figure 1C:
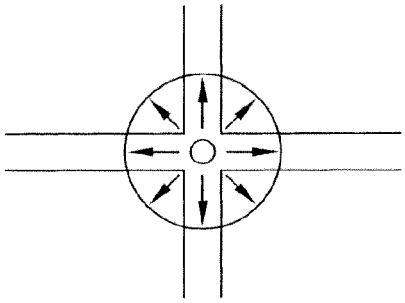
Figure 1D:
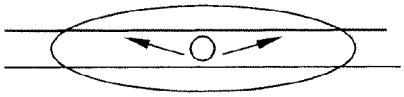
Figure 1E:
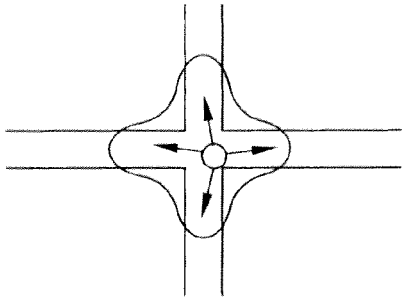
Figure 1F:
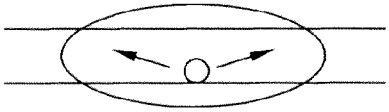
Figure 1G:
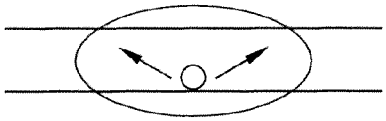
Figure 2:
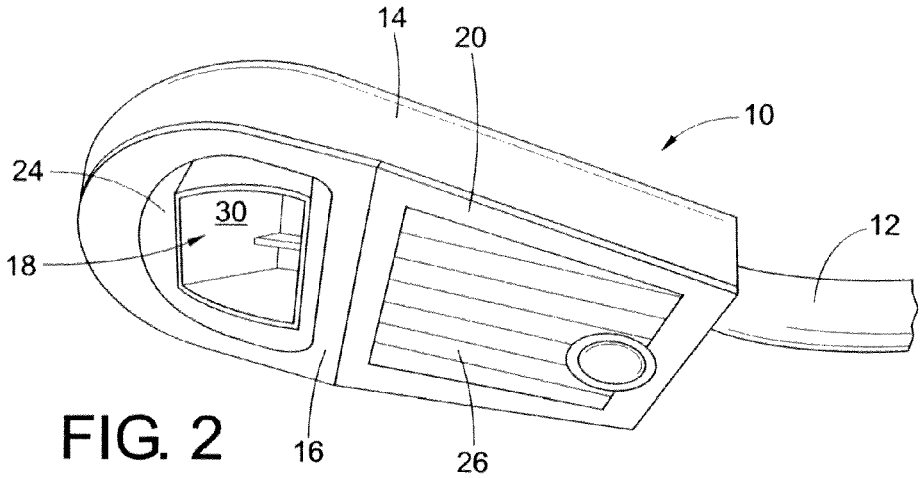
FIG. 2 is a perspective view of a the roadway luminaire.

Referring now to FIG. 2, a generally cobra-head shaped luminaire 10 is depicted on a lamp post 12. Luminaire 10 is comprised of a housing 14 including a first door 16 providing access to a optical module chamber 18 and a second door 20 providing access to an electronics module chamber.

Although shown as a component of the luminaire, it is conceivable that the electronics module be located remote thereto, moreover, the key function of the electronics module is to condition AC to DC for use with LED's. The electronics module does not need to be in the fixture to accomplish this goal. Similarly, providing LED's functional with AC current would eliminate the need for an electronics module.

Door 16 is equipped with a transparent or translucent cover 24. Translucent cover 24 may be comprised of plastic, an AR coated glass, glass including pillow optics, molded glass, and pane glass including etching or other light spreading materials. Door 20 is equipped with heat fins 26. However, it is noted that heat fins are not necessary elements. Optical module 30 resides within light module chamber 18.

Figure 3:
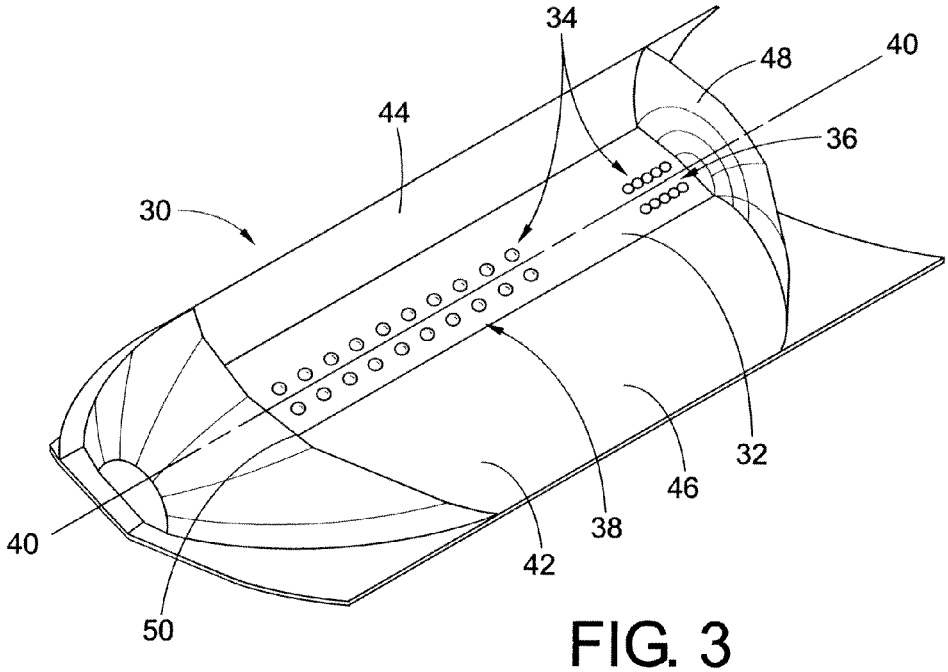
FIG. 3 is a perspective view of a single lamp module.

Turning now to FIG. 3, optical module 30 is comprised of an elongated light source including printed circuit board 32 (PCB) including a plurality of LEDs 34 disposed thereon. LEDs 34 are disposed in three arrays, a first array 36, a central array 38 and a third array (not shown). The arrays can vary in number, LED count, and design. Moreover, the present disclosure contemplates, an array being comprised of from one to many LED's. As few as two, one LED arrays may be employed. However, it may be desirable to provide a symmetrical array design to allow the optic orientation to be flipped without effecting the electrical or mechanical connections provided within the luminaire. Furthermore, ease of assembly can be improved. PCB 32 preferably has a reflective surface or cover and is disposed at an optical axis 40 of reflector 42.

Reflector 42 includes elongated curved opposed longitudinal side walls 44 and 46 and opposed curved end walls 48 and 50. Most commonly the sidewalls will be concave. Furthermore, the sidewalls will typically be straight in the longitudinal dimension.

Importantly, it is noted that the term "curve" is not intended to imply a continuous curve. Rather, curve is intended to encompass a reflector wall having at least two planar segments angled relative to one another. The end walls 48 and 50 in FIG. 2 depict this design wherein multiple segments are angled relative to one another to form an overall side to side curvature. Similarly, it is contemplated that the reflector walls can have planar portions interspersed by one or more curved portions. In addition, it is contemplated that the degree of curvature can vary throughout the extent of the wall.

The end walls 48 and 50 can be opposed curved surfaces. Furthermore, the end walls can comprise both a curve from side to side (horizontally), and from top to bottom (vertically). As will be described below in greater detail, the reflector design is selected to provide a non-reflected direct light component and a reflected light component. In this manner, direct light can be provided on the ground surface primarily below the post mounted luminaire, and reflected light provided forward, rearward and sideways. In short, it is noted that various combinations of direct and reflected light can and are provided by the subject luminaire design. Similarly, it is noted that light reflected from numerous surfaces will be emitted from the present optical module.

The end walls and the elongated sidewalls cooperate to generally maintain transverse control of the beam even from the high angle light aimed between the poles. High angle energy is achieved in a small form factor along with full mechanical cut-off by creating a converging then diverging beam from each end. In this regard the end walls and sidewalls cooperate to provide linear control of light because light exiting the optical module is controlled in both roadway and side directions. For example, light reflected from the endwalls and directed substantially sideways down the road is constrained from spreading by the longitudinal sidewall reflector.

The reflector can be formed of multiple cooperative pieces. It is preferably formed of a highly reflective material and/or includes a highly reflective coating. It is envisioned that the reflector can be molded, die cast or stamped from sheet metal or another material or combinations of materials. In short, the process for reflector manufacture is not considered to be limiting. However, the fact that the reflector manufacture methods are diverse provides economic advantages.

Figure 4B:
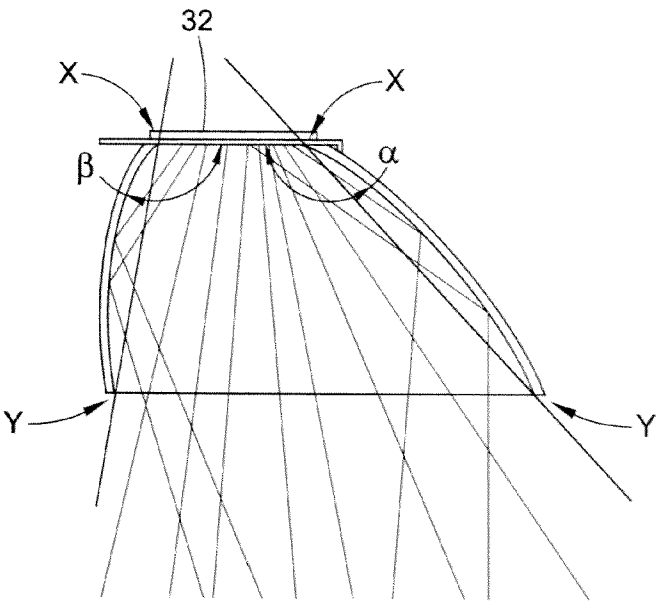
FIGS. 4 (*a*), (*b*), (*c*) and (*d*) are transverse cross-sectional views demonstrating four different reflector shapes.
Figure 4A:
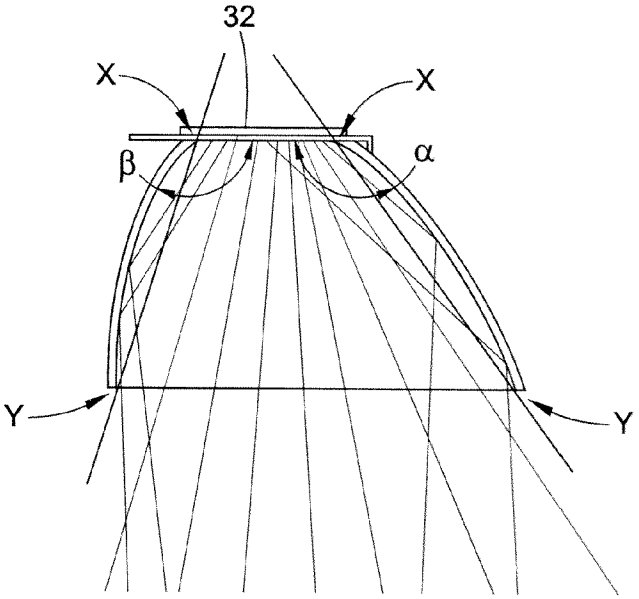
Figure 4D:
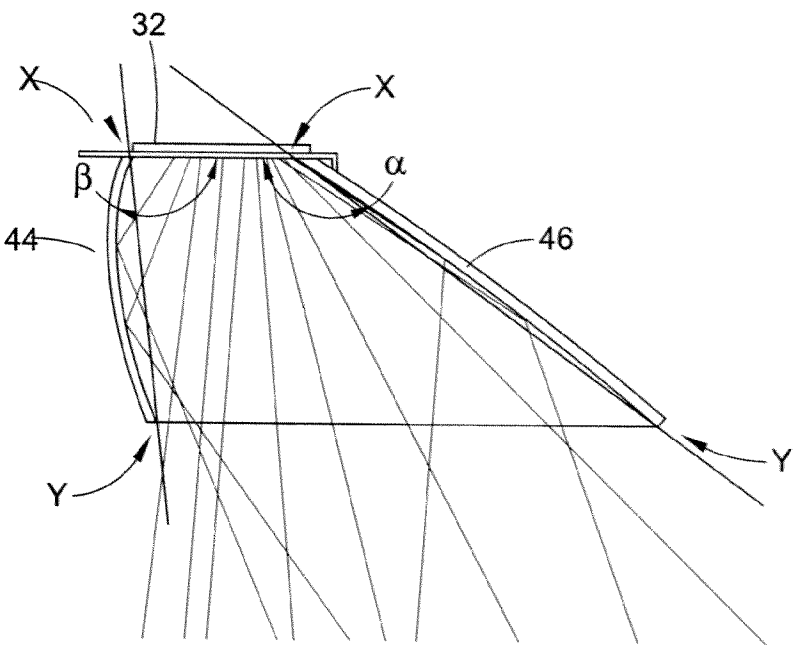
Figure 4C:
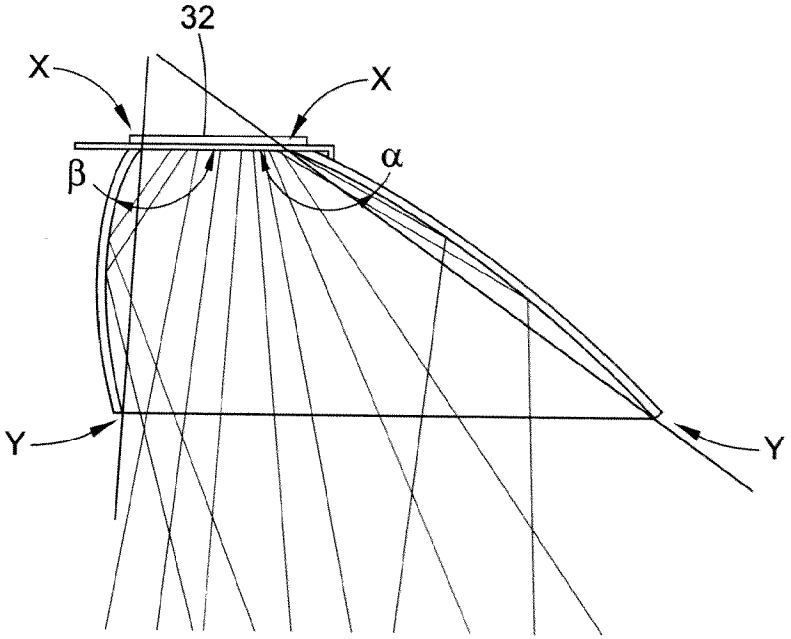

Referring now to FIGS. 4A-4D it can be seen that in cross-section longitudinal side walls 44 and 46 each have a curved shape in the vertical direction. The depicted light tracings demonstrate that a significant quantity of direct (e.g., ~50%) light exits the reflector 42 in a direction normal to or within approximately 40 degrees to the planar orientation of PCB 32. In addition, a quantity of light is reflected from each of side walls 44 and 46 to provide a predesigned quantity of forward or rearward light. Modifying the shape of the curved walls can be performed to obtain modifications in the light distribution of the luminaire. Moreover, wall 46 has an angle α relative to the printed circuit board that can vary the forward light distribution of the light module. The angle is being calculated based upon the overall inclination of the wall as defined by a line extending between the walls point of engagement x with the surface supporting the PCB and its terminal point y. This definition is relative because, as described above, the curvature of the reflector wall can fluctuate over its length. For example, in 4A, α equals approximately 125 degrees and provides a relatively higher concentration of light distribution directly below the light module. Referring now to FIG. 4B, a α of approximately 135 degrees is depicted and additional forward distribution is accomplished as non-reflected light exiting directly from the LEDs in a forward direction is increased. Referring now to FIGS. 4C and 4D, further increase of angle α (143 and 145 degrees respectively) demonstrates that increased forward projection of non-reflected light from the PCB generating LEDs is achieved. In this manner, light can be cast further onto a roadway surface remote from a lamp pole adjacent to the edge of the roadway. Furthermore, a comparison or wall 46 in FIG. 4C and FIG. 4D demonstrates that modifying the curvature can change the distribution of the light reflected from wall 46 (both single and multiple reflection).

Referring now to longitudinal side wall 44, modifying angle beta (the angle between wall 44 and the planar orientation of the PCB can also increase forwardly directed light. More particularly, narrowing of angle β achieves greater reflectance in the forward direction of light generated by the LEDs. For example, β in FIG. 4A is approximately 110 degree, whereas β in FIG. 4D is less than 90 degrees. The light tracings show that increased forward light is achieved via the FIG. 4D design. Generally, the FIG. 4A reflector may be suitable for a one-lane road, the FIG. 4B reflector for a two-lane road, the FIG. 4C reflector for a three-lane road, and the FIG. 4D reflector for a four lane road.

Figure 5:
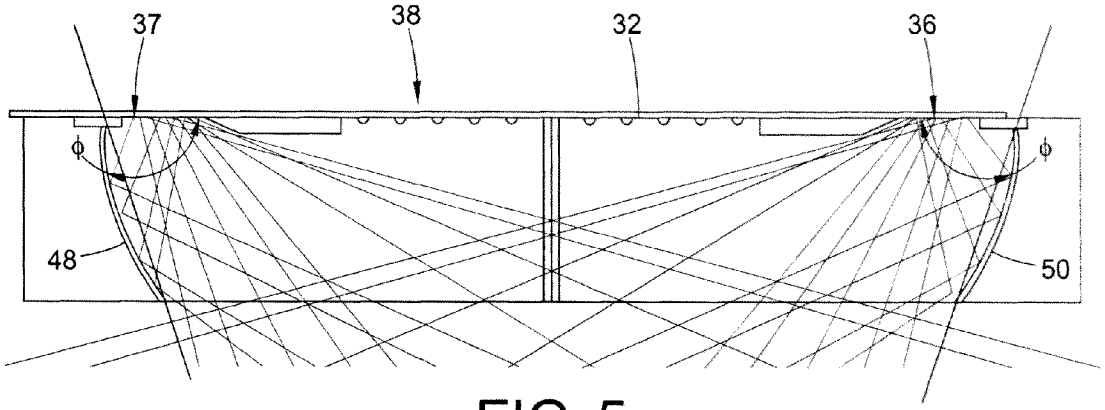
FIG. 5 is a longitudinal cross-sectional view illustrating a reflector suitable for a long pole spacing environment.
Figure 6:
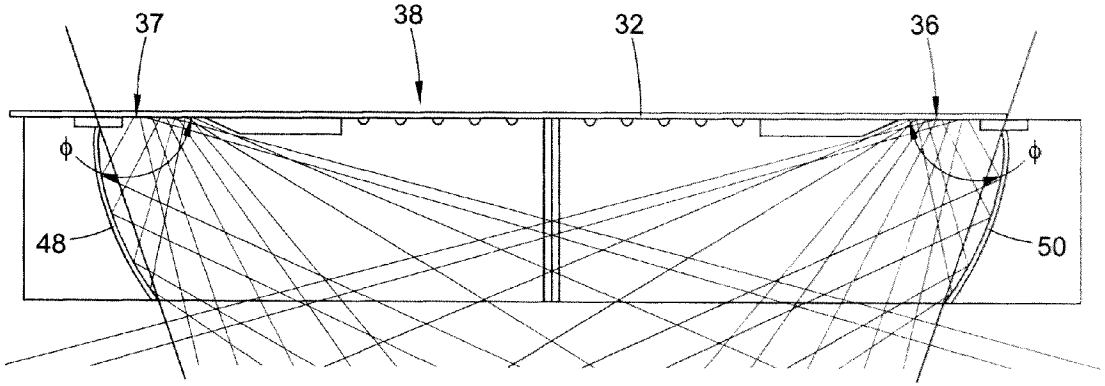
FIG. 6 is a longitudinal cross-sectional view illustrating a reflector suitable for a short pole spacing environment.

Turning now to FIGS. 5 and 6, the functionality of the end walls 48 and 50 is displayed. Moreover, in FIG. 5, end walls 48 and 50 have an angle theta of approximately 75 degrees relative to the printed circuit board which provides for a preselected quantity of reflected light (particularly from end LED arrays 36 and 37) in a longitudinal or sideways direction substantially toward an adjacent lamp pole. Again, the angle is determined between the planar orientation of the LED array and a line extending, between a first and second end of the curved reflector wall. Referring to FIG. 6, theta is approximately 70 degrees which provides increased reflectance of light in a longitudinal direction. In this manner, if lamp poles are spaced at a greater distance from one another, end walls 48 and 50 can be designed to provide increased reflectance to achieve greater light distribution in a longitudinal direction relative to the luminaire. More particularly, FIG. 5 is depicted as a short pole spacing whereas FIG. 6 depicts a long pole spacing.

The flexibility of having these various reflector designs available allows maximum CU to be achieved for the necessary illumination patterns depicted in FIG. 1, and provides maximum efficiency for the different pole spacing patterns encountered. In addition, as mentioned above, the present luminaire system is provided with multiple LED loadings and optionally various LED array layouts. In this manner, light emitted at the PCB ends, adjacent reflector walls 48 and 50 can be increased or decreased dependent upon the need for improved uniformity or greater pole spacing. Similar adaptability exists for increasing forward or rearward generated light. In short, the provided luminaire system is highly flexible and achieves improved CU, for example, a CU value of at least 60% is achieved on the road, surface and greater than 90% if the sidewalk surface is taken into consideration. The controlled lighting of a roadway surface is achieved because the sidewall reflectors and endwall reflectors are interactive. In this regard, at least about 40% of light emitted by an astral array of LED's exits the optical module as non-reflected light. In contrast, at least about 50% of light emitted by the end arrays exits the optical module as reflected light, while up to 50% exits as non-reflected light, and in certain embodiments between about 1% and about 25% exits as non-reflected light.

Figure 7:
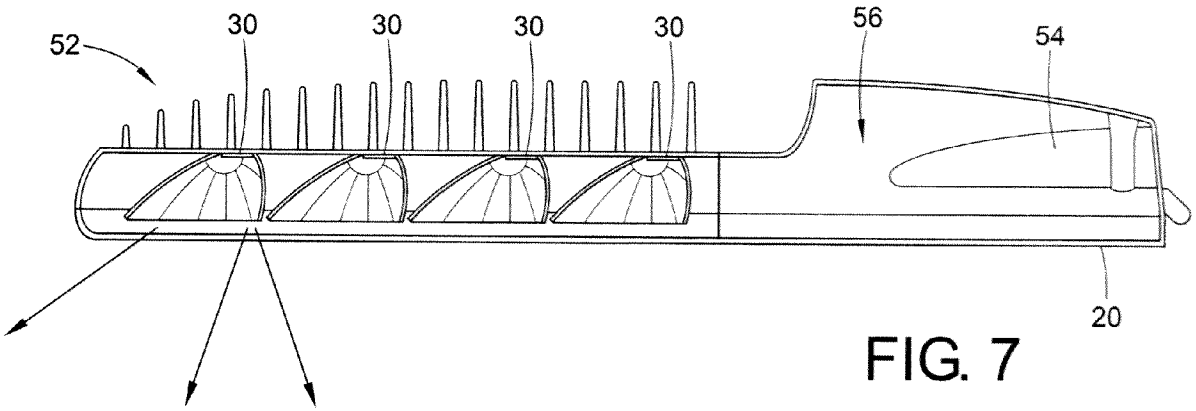
FIG. 7 is a side cross-sectional view of a four module luminaire design.

Referring now to FIG. 7, a further adaptability of the present luminaire is provided. Moreover, it is envisioned that the luminaire can comprise between one and multiple light modules. In FIG. 7, four light modules 30 are provided. The adaptability of the system can readily be perceived in that modules can be tailored between those depicted and FIGS. 4-6 with preselected alpha, beta, and theta reflector wall angles to achieve any type of light distribution envisioned by the system designer.

Additional aspects of the luminaire design depicted in FIG. 7 include heat fins 52 and electronics module 54, disposed within electronics module chamber 56.

Figure 8:
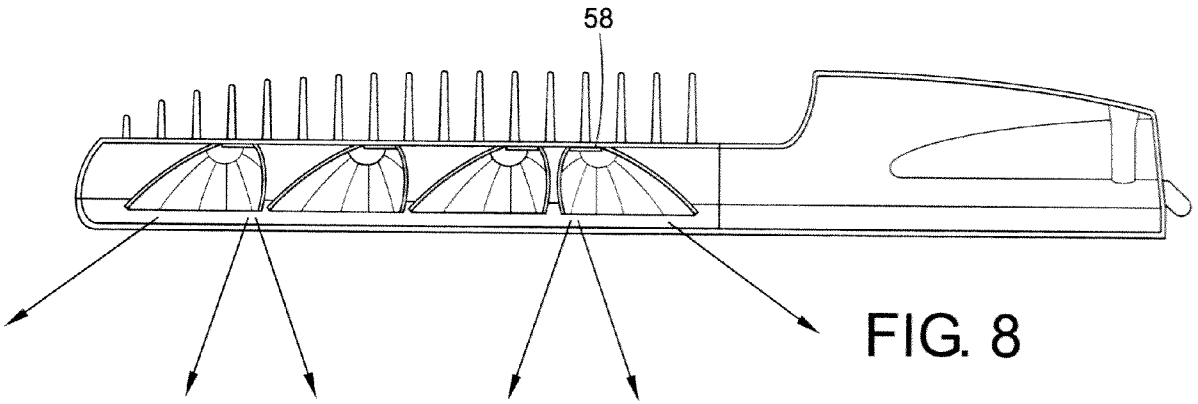
FIG. 8 demonstrates the adaptability of the luminaire achieved via a reversed orientation of a light module of FIG. 7.

Furthermore, as depicted in FIG. 8, light module 58 has been reversed in orientation (opposed optical axis) to provide rearward lighting in a situation, for example, wherein a sidewalk or other transportation way etc. requires illumination. Moreover, HID fixtures typically have less precise control of light placement that will light up the surrounding areas including the sidewalk behind the pole. Municipalities and residents have grown used to having these secondary areas lit. To the extent that remains desired, the present system can achieve that goal without sacrificing CU as was the case with poorly controlled HID light distribution. Because the modules use symmetric PCB designs, this reversibility function is readily achieved.

Figure 9:
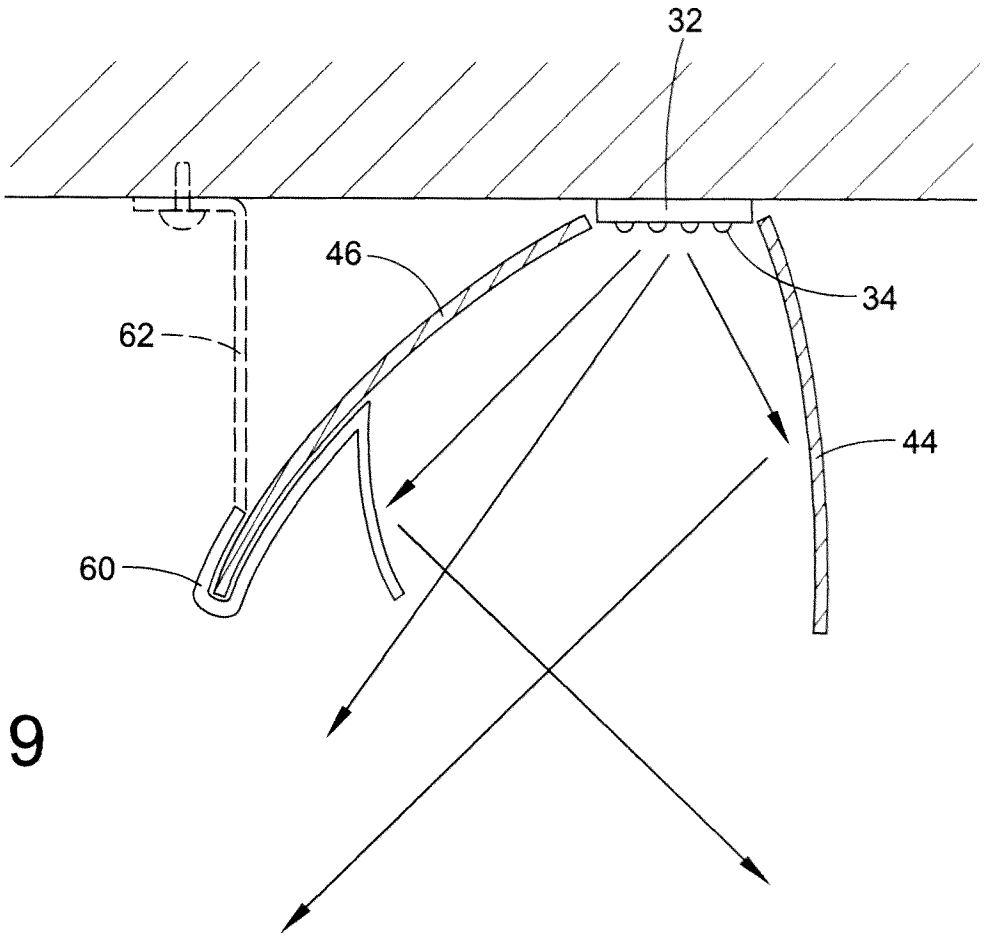
FIG. 9 is a cross-section view of a reflective clip designed to achieve rearward illumination.

Referring now to FIG. 9, it is noted that as opposed to providing a reversed light module to achieve rearward lighting, it is feasible to provide the reflector wall 46 with a reflective clip 60 to increase rearward reflectance. The clip could be sized to form a compression fit with the reflector wall or a mounting arm 62 could be provided to secure the reflector clip to the fixture housing. Depending upon the desired level of reflectance, the clip 60 can extend the entire longitudinal dimension of the wall 46, or may occupy only a portion thereof. Similarly, multiple clips can be employed.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A roadway luminaire comprising a housing including at least one optical module, the optical module being comprised of an elongated light source disposed within a reflector, the reflector comprised of opposed curved longitudinal walls and opposed curved end walls, said end walls being oriented inwardly 90° or less relative to a plane in which said light source resides.

2. The luminaire of claim 1, including at least two optical modules.

3. The luminaire of claim 2, wherein said at least two optical modules have differently shaped curved longitudinal walls.

4. The luminaire of claim 3 wherein said at least two optical modules have at least substantially equivalently shaped endwalls.

5. The luminaire of claim 1 wherein said light source comprises a plurality of LED's.

6. The luminaire of claim 2, wherein said at least two optical modules have optical axis in opposite directions.

7. The luminaire of claim 1, wherein at least one of said longitudinal walls includes a reflective clip element.

8. The luminaire of claim 7, wherein said clip element is compression fit to an edge of said wall.

9. The luminaire of claim 7, wherein said clip is supported by said luminaire housing.

10. The luminaire of claim 1, where said opposed end walls are curved in each of a horizontal and a vertical direction.

11. The luminaire of claim 1 wherein said longitudinal walls are longer than said end walls.

12. The luminaire of claim 1 wherein at least one of said longitudinal walls is oriented inwardly 90° or less relative to said plane.

13. The luminaire of claim 1 wherein at least one of said longitudinal walls is oriented outwardly 90° or more relative to the plane in which said light source resides.

14. A roadway luminaire comprising a housing including an electronics module and at least optical module, the optical module is comprised of a printed circuit board (PCB) including a plurality of light emitting diodes and a reflector encompassing said printed circuit board, said light emitting diodes being disposed in at least three arrays, a first array disposed adjacent a first end of said PCB, a second array disposed adjacent a second end of said PCB, and a third array disposed between said first and second, said reflector having endwalls oriented inwardly 90° or less relative to a plane in which said printed circuit board resides and at least one longitudinal wall oriented outwardly greater than 90° relative to the plane in which said printed circuit board resides.

15. The luminaire of claim 14 wherein at least about 40% of said light emitted by said third array exits said housing as non-reflected light.

16. The luminaire of claim 15, wherein at least 50% of the light emitted by said first and second arrays exits said housing as reflected light.

17. The luminaire of claim 16, wherein between about 1% and about 25% of the light emitted by said first and second arrays exits said housing as non-reflected light.

18. The luminaire of claim 17 comprising at least two optical modules.

19. A luminaire comprised of a housing including at least one optical module, said optical module comprised of a plurality of light emitting diodes disposed within a reflector, said reflector having opposed curved sidewalls and opposed curved end walls, said curved sidewalls oriented at different angles from one another relative to a plane in which said light emitting diodes reside.

20. The luminaire of claim 19 wherein said end walls are curved both horizontally and vertically.

* * * * *